US010961711B2

(12) United States Patent
Schmidt

(10) Patent No.: US 10,961,711 B2
(45) Date of Patent: Mar. 30, 2021

(54) REINFORCEMENT SYSTEM AND A METHOD OF REINFORCING A STRUCTURE WITH A TENDON

(71) Applicant: Danmarks Tekniske Universitet, Kgs. Lyngby (DK)

(72) Inventor: Jacob Wittrup Schmidt, Copenhagen Ø (DK)

(73) Assignee: Danmarks Tekniske Universitet, Kgs. Lyngby (DK)

( * ) Notice: Subject to any disclaimer, the term of this patent is extended or adjusted under 35 U.S.C. 154(b) by 0 days.

(21) Appl. No.: 15/528,406

(22) PCT Filed: Nov. 19, 2015

(86) PCT No.: PCT/EP2015/077040
§ 371 (c)(1),
(2) Date: May 19, 2017

(87) PCT Pub. No.: WO2016/079214
PCT Pub. Date: May 26, 2016

(65) Prior Publication Data

US 2017/0335568 A1 Nov. 23, 2017

(30) Foreign Application Priority Data

Nov. 21, 2014 (EP) ..... 14194291

(51) Int. Cl.
*E04C 5/12* (2006.01)
*E04C 5/07* (2006.01)
(Continued)

(52) U.S. Cl.
CPC ..... *E04C 5/12* (2013.01); *E04C 5/07* (2013.01); *E04C 5/085* (2013.01); *E04C 3/20* (2013.01); *E04C 5/10* (2013.01)

(58) Field of Classification Search
CPC ... E04C 5/12; E04C 5/085; E04C 5/10; E04C 5/07; E04C 3/20
See application file for complete search history.

(56) References Cited

U.S. PATENT DOCUMENTS 3,232,638 A * 2/1966 Hollander ..... E21B 17/16 138/109
3,588,045 A * 6/1971 Stubbs ..... E04C 5/122 254/29 A (Continued)

FOREIGN PATENT DOCUMENTS

KR 2009 0041017 A 4/2009
WO 02/103137 A1 12/2002
WO 03/062551 A1 7/2003

OTHER PUBLICATIONS

International Search Report corresponding to International Patent Application No. PCT/EP2015/077040, European Patent Office, dated Jul. 28, 6(3 pages).

(Continued)

*Primary Examiner* — Basil S Katcheves
*Assistant Examiner* — Omar F Hijaz
(74) *Attorney, Agent, or Firm* — Nixon Peabody LLP

(57) ABSTRACT

A reinforcement system for anchoring tendons for structural reinforcing a structure such as a concrete structure, said reinforcement system comprises at least one anchor and at least one tendon, said anchor is adapted to fix said tendon in and/or outside said structure, wherein said reinforcement system comprises a ductility element, which is positioned in structural connection between said tendon and said anchor, said ductility element comprising weakened deformation zones being deformable so that the length of the ductility is increased or decreased in an axial direction along the length of said tendon.

13 Claims, 6 Drawing Sheets

(51) Int. Cl.

| | |
|---|---|
| ***E04C 5/08*** | (2006.01) |
| ***E04C 5/10*** | (2006.01) |
| *E04C 3/20* | (2006.01) |

(56) References Cited

U.S. PATENT DOCUMENTS

| | | | | |
|---|---|---|---|---|
| 3,820,832 | A * | 6/1974 | Brandestini et al. | E04C 5/122 24/115 A |
| 4,417,427 | A * | 11/1983 | Bschorr | E02D 27/34 52/167.1 |
| 4,773,198 | A * | 9/1988 | Reinhardt | E04C 5/122 52/223.13 |
| 6,082,063 | A | 7/2000 | Shrive et al. | |
| 8,425,143 | B2 * | 4/2013 | Kondo | F16G 11/02 403/368 |
| 8,757,934 | B2 * | 6/2014 | Hall | E21D 20/028 405/259.1 |
| 9,091,064 | B1 * | 7/2015 | Dahl | E04C 5/122 |
| 2001/0000840 | A1 * | 5/2001 | Takeuchi | E04H 9/02 52/167.1 |
| 2002/0083659 | A1 * | 7/2002 | Sorkin | E04C 5/08 52/167.1 |
| 2004/0213976 | A1 * | 10/2004 | Hoa | E04C 5/07 428/292.1 |
| 2006/0179742 | A1 * | 8/2006 | Mathews | E04C 5/122 52/223.13 |
| 2014/0123593 | A1 | 5/2014 | Wu | |

OTHER PUBLICATIONS

International Written Opinion corresponding to International Patent Application No. PCT/EP2015/077040, European Patent Office, dated Jul. 28, 2016; (5 pages.

* cited by examiner

REINFORCEMENT SYSTEM AND A METHOD OF REINFORCING A STRUCTURE WITH A TENDON

CROSS-REFERENCE TO RELATED APPLICATIONS

This application is a U.S. National Stage of International Application No. PCT/EP2015/077040, filed Nov. 19, 2015, which claims the benefit of European Patent Application No. 14194291.2, filed Nov. 21, 2014, both of which are incorporated herein by reference in their entireties.

The present invention relates to a reinforcement system for anchoring tendons for structural reinforcing a structure such as a concrete structure, said reinforcement system comprises at least one anchor and at least one tendon, said anchor is adapted to fix said tendon in and/or outside said structure.

BACKGROUND OF THE INVENTION

Ductility of structures is important to ensure large deformation and give sufficient warning while maintaining an adequate load capacity before structure failure. Concrete is a brittle material. Concrete structures rely largely on the deformation and yielding of the tensile reinforcement to satisfy the ductility demand.

The application of high strength steel reinforcement in concrete structures has less ductility due to the lower degree of strain hardening and smaller elongation of the tensile reinforcement.

The application of fiber reinforced polymer (FRP) reinforcement has a similar problem, as FRP have a low strain capacity and linear elastic stress-strain behavior up to rupture without yielding.

Thus, the ductility of concrete members reinforced with non-ductile tendons, especially FRP reinforced concrete members, decreases due to the tensile reinforcement deforms less and hence a lower deformability and ductility is achieved.

US2014/0123593 discloses a method of improving the ductility of a structural member, such as a reinforced concrete beam or column reinforced by tensile members made of high strength steel or FRP, by providing a region of increased compression yielding in the compression zone of a plastic hinge region or nearby. This can be achieved by forming a mechanism provided in the compression zone to provide the ductile compression zone.

U.S. Pat. No. 6,082,063 discloses an anchorage for a tendon that includes a sleeve having a smooth tapered interior bore and a compressible wedge disposed in the sleeve. The compressible wedge has a smooth exterior tapered surface tapering from a wider end to a narrower end and one or more interior channels for receiving a tendon. The taper angle of the compressible wedge is greater than the taper angle of the bore. Thus, upon insertion of the compressible wedge into the sleeve, the wider end of the compressible wedge forms a wedge contact with the sleeve before the narrower end forms a wedge contact with the sleeve. Hereby is achieved an appropriate anchorage system for FRP tendons.

In many cases, it is desirable to provide an improved structural ductility of high strength steel or FRP reinforced concrete members.

BRIEF DESCRIPTION OF THE INVENTION

It is an object of the present invention is to provide an improved ductility of reinforced structural members.

This is achieved by said reinforcement system comprises a ductility element, which is positioned in structural connection between said tendon and said anchor, said ductility element comprising weakened deformation zones, said weakened deformation zones are configured for increasing the ductility of said reinforcement system, said weakened deformation zones being deformable and thereby said weakened deformation zones are configured for allowing the length of deformation zones on the ductility element to increase or decrease in an axial direction along the length of said tendon, when the stress on the ductility element exceeds a certain level.

This results in the ductility element by elongation or compression increases the ductility in the reinforcement system.

In an embodiment, said ductility element comprises multiple deformable zone positioned subsequent in an axial direction along the length of said tendon, thus providing subsequent deformable zones, enabling a sequence of ductility.

Hereby is achieved that each deformation zone, when it collapses, only gives rise to a limited length reduction of the complete ductility element, and thereby the ductility element can initially adapt to small variations in the mounting of the tendon and the anchor, and thereafter provide the required ductility due to the remaining undeformed deformation zones.

In an embodiment, the ductility element comprises a through going channel, said through going channel being disposed internally within the one or more deformable zones for receiving said tendon, the through going channel being disposed such that the tensile force on the tendon during use are oriented along the extension of the through going channel.

Hereby is achieved that all the deformation zones are subjected to the same force applied by the stress in the tendon, and the weakest deformation zone will thereby collapse first.

In an embodiment, the reinforcement system is configured such that the force required for deformation of the ductility element in axial load is less than the force required for deformation of the tendon.

In an embodiment, the ductility element is configured such that the force required for deformation of the ductility element in axial load being about 30-95%, preferably 70-95% of the force required for deformation of said tendon.

In an embodiment, the ductility element is an integrated part of said anchor.

In a further embodiment, said ductility element comprises a circular cross section and said anchor comprises a barrel having a smooth tapered interior bore and a compressible wedge adapted to be disposed in said barrel.

In a further embodiment, said ductility element is positioned at one extremity of said anchor as an extension of the barrel.

In another embodiment, said ductility element comprises a rectangular cross section and said internal channel comprises a rectangular cross section for the lead through of a tendon having a corresponding rectangular cross section.

The present invention further relates to a method of reinforcing a structure with a tendon, comprising fixing the tendon to the structure at different positions, and where the tendon is fixed to the structure by using ductility elements at each position, an where each ductility element is weakened at local deformation zones, and thereby deforms when the stress on the ductility element exceeds a certain level so that the length of the deformation zone on the ductility element is increased or decreased in an axial direction along the length of said tendons.

The term tendon should be understood as any type of reinforcement element of steel or fibers, such as FRP cable or rods, e.g. carbon, aramid or glass fiber reinforced polymer, although other material also may be used.

BRIEF DESCRIPTION OF THE DRAWINGS

Embodiments of the invention will be described in the following with reference to the drawings wherein.

DETAILED DESCRIPTION OF THE INVENTION WITH REFERENCE TO THE FIGURES

The present invention relates to a reinforcement system for anchoring tendons for structural reinforce a structure such as a concrete structure.

Figure 1:
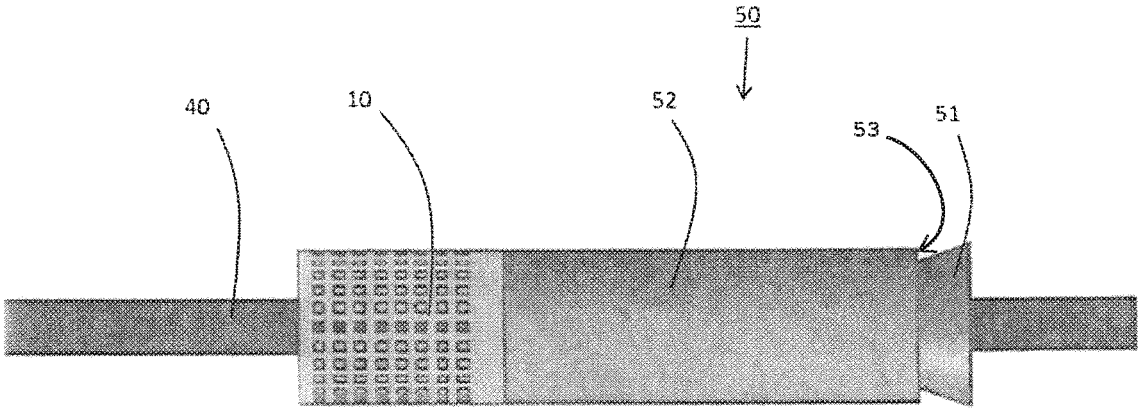
FIG. 1 illustrates a ductility element in connection with a barrel and wedge anchor.

FIG. 1 illustrates a reinforcement system which comprises an anchor (50) adapted to fasten a tendon and a ductility element (10) within a structure.

The anchor (50) is schematically illustrated as a known type of an anchor comprising a barrel (52) and wedge (51), wherein the barrel has a tapered interior bore (53) and the compressible wedge being adapted to be coaxially disposed in the barrel. The tendon (40) extends through the center of the wedge, which is wedged coaxially inside the barrel for clamping the tendon (40), and thereby anchoring the tendon in a structure.

Furthermore, the reinforcement system comprises a ductility element (10), which is positioned in structural connection between said tendon (40) and said anchor (50), said ductility element comprises weakened deformation zones being deformable in axial direction along the length of said tendons. The deformation zones are weakened in relation to the other part of the ductility element.

The ductility element is configured such that the force required for deformation of the ductility element in axial load is less than the force required for deformation of the tendon. Thus, the ductility element (10) has a ductile phase in axial load less than the tensile strength of the tendons, thus making the ductility element the weakest link in the reinforcement system. The ductility element (10) will reach its strength before the other components of the reinforcement system. When the stress excides the threshold of the ductility of the ductility element, the ductility element will deform and it thus provide ductility to the reinforcement system.

As concrete is a brittle material. Concrete structures rely on the deformation and yielding of the tensile reinforcement to satisfy the ductility demand. By employing a ductility element in combination with tendons made of high strength steel or fiber lacking of sufficient ductility by allowing the ductility element to deform and thus provide an increased ductility.

Figure 2:
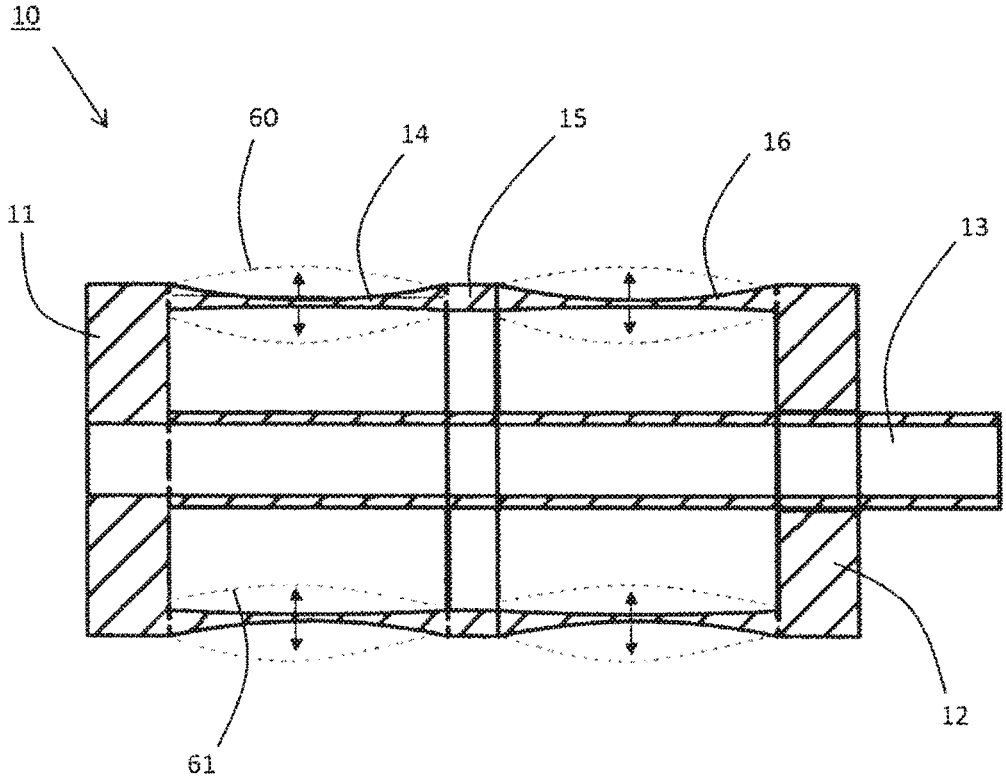
FIG. 2 is a schematic view of a ductility element.

FIG. 2 illustrates a first embodiment of the ductility element (10).

The ductility element comprises a first end (11), a second end (12), two deformable walls (14,16) and a through going channel (13) adapted for receiving a tendon, the through going channel extends centrally internal through said ductility element, from said first end (11) to the far side of the second end (12) thereby both deformable walls are subjected to the same force applied by the stress in the tendon, and the weakest one will thereby collapse first.

The two deformable walls (14,16) are divided into sequential zones by a partition (15).

As the two deformable walls (14,16) has varying thickness enables the ductility element to deform upon loads, and as illustrated in FIG. 2, the weakened deformable walls are able to deform in radial direction in respect of the centerline of the ductility element and the fluctuation of the deformable wall are illustrated by dotted lines (60,61) in the FIG. 2.

The ductility element is prefabricated and may be cast directly into a structural member, such as a concrete structure, or applied to the structural member afterwards. Furthermore, the reinforcement system may be used inside a concrete structure as well as on the outside of the structure, and as the tendons and ductility element may be made of non-corrosive material, thus it is suitable for being used in more aggressive environments.

Figure 3:
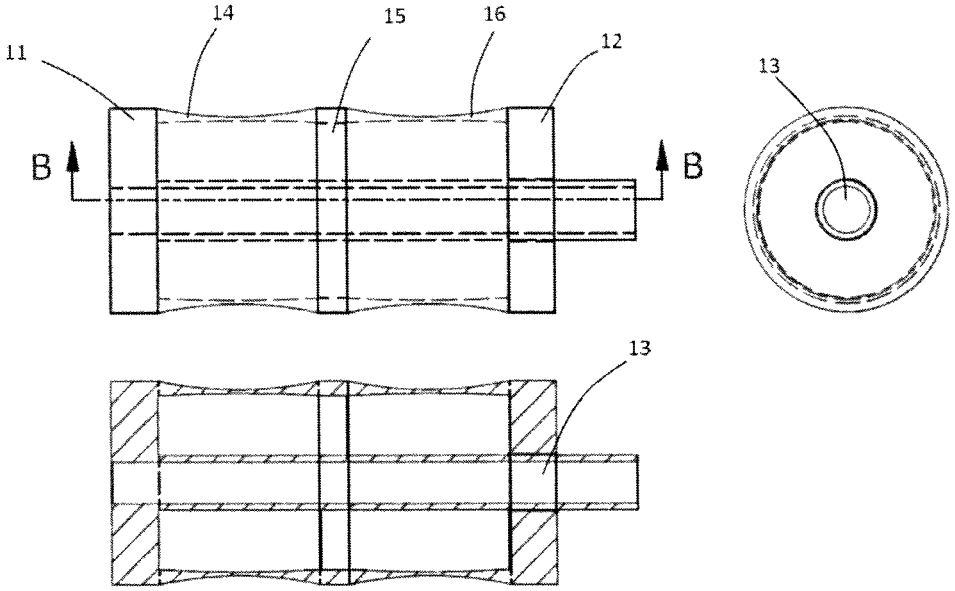
FIG. 3 is a schematic view of a ductility element, a cross sectional view of the ductility element in a line indicated by B, and an end view of the ductility element.

FIG. 3 is a schematic view of a ductility element as illustrated in FIG. 2. FIG. 3 additionally illustrates a cross sectional view of the ductility element in a line indicated by B, and an end view showing the ductility element (10) having a circular cross section and a centrally circular through going channel (13), which extends coaxially within the ductility element.

Figure 4:
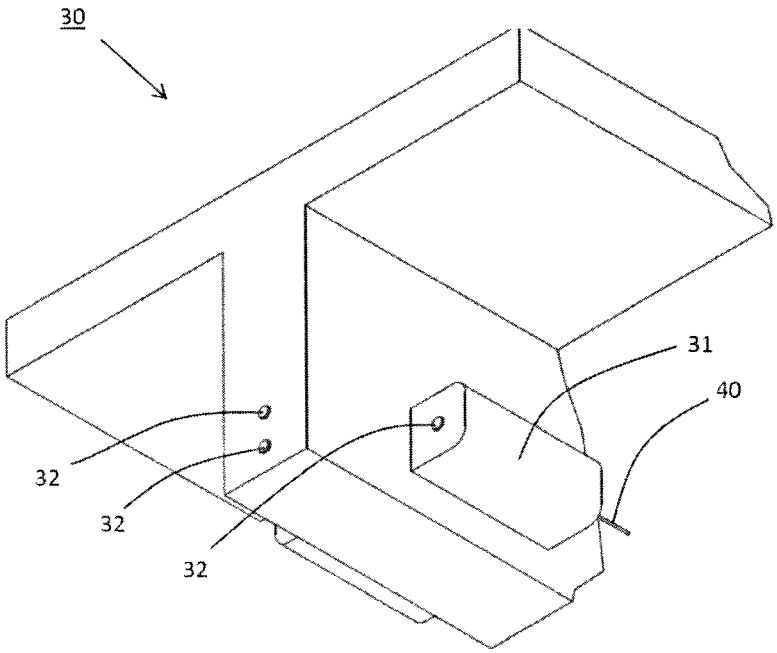
FIG. 4 is a perspective view of a T-shaped structure.

A T-shaped structure (30) illustrated in a perspective view is shown in FIG. 4, comprising visibly three reinforcement systems, two anchorage system internal positioned in the center of the T-shaped structure covered by caps (32) and one anchorage system mounted externally in a sup structure (31). The reinforcement system in the sub structure (31) extends from the sub structure and outside both structures (30,31).

Figure 5:
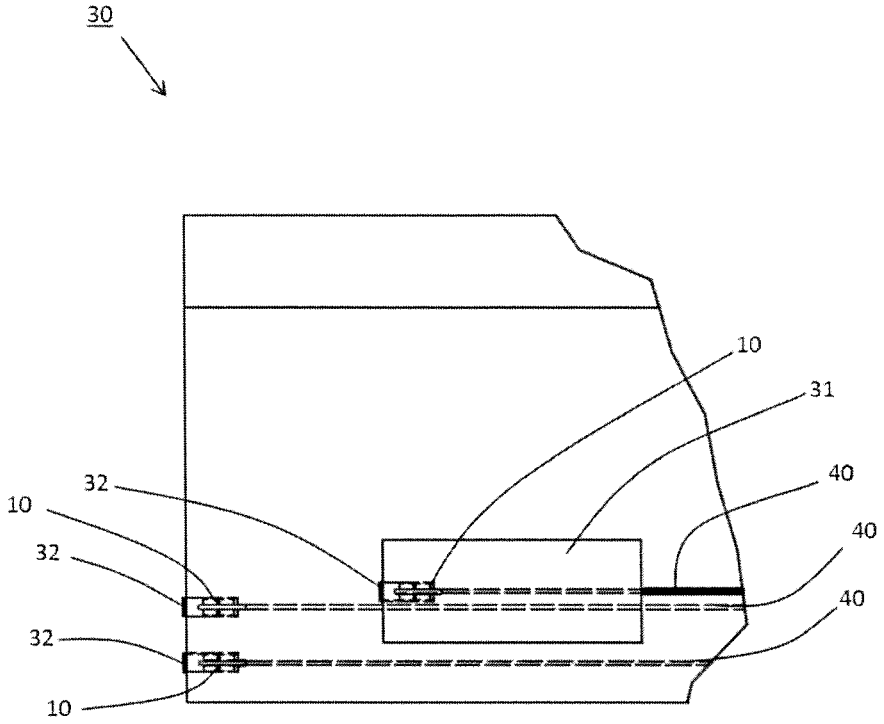
FIG. 5 is a side view of the T-shaped structure shown in FIG. 4.

The same structure (30) is illustrated in FIG. 5 as a side view.

FIG. 5 illustrates the two reinforcement system comprising a ductility element (10) internal positioned at one extremity of the T-shaped structure. The additional structure (31) comprises a ductility element (10) coupled to the tendons inside the sub structure, and having the tendon extends through the sub structure and outside both structures. The three reinforcement systems are covered by a cap (32).

Figure 6:
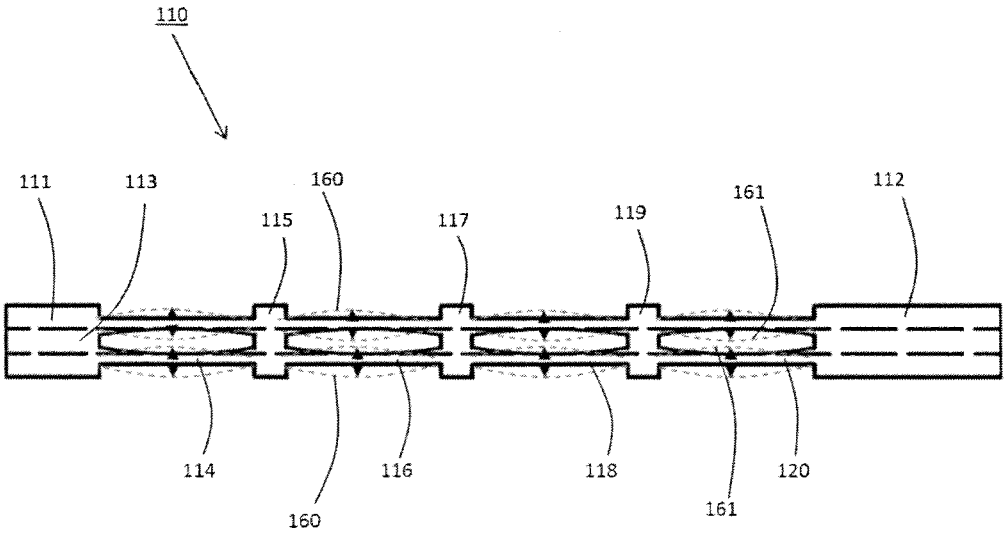
FIG. 6 is a schematic side view of another embodiment of a ductility element.

Another embodiment of the ductility element (110) is illustrated in FIG. 6.

The ductility element (110) comprises a first end (111), a second end (112), four deformable walls (114,116,118,120) and a through going channel (113) adapted for receiving a tendon, the through going channel extends centrally internal through the ductility element, from the first end (111) to the second end (112). The through going channel (113) is adapted for flat tendons having a rectangular cross section.

The four deformable walls (114,116,118,120) are divided into sequential zones by the partitions (115,117,119), defining four compression zones.

The lead through of a tendon in the thought going channel (113) disposed within the one or more deformable zone, the through channel being disposed such that the tensile force on the tendon during use are oriented along the through going channel (113) within the ductility element (110).

The four deformable walls (114,116,118,120) by having varying thickness are weakened and therefore able to deform, when the ductility element being loaded.

The weakened deformation zones are deformable so that the length of the ductility element is increased or decreased in an axial direction along the length of a tendon.

In FIG. 6 the deformation of the weakened deformable walls are illustrated by dotted lines. During increasing pressure the ductility element will, when threshold for elastic deformation is reached, start to deform followed by a deformation resulting in a collapse.

The ductility element (110) has a ductile phase in axial load less than the tensile strength of the tendons, thus making the ductility element the weakest link in the reinforcement system, and the ductility element (110) will reach its strength before the other components of the reinforcement system.

The ductility element will deform when the stress excides the threshold of the ductility element, and it thus provides ductility to the reinforcement system. Thus ductility is achieved by applying a ductility element to the reinforcement system.

Figure 7:
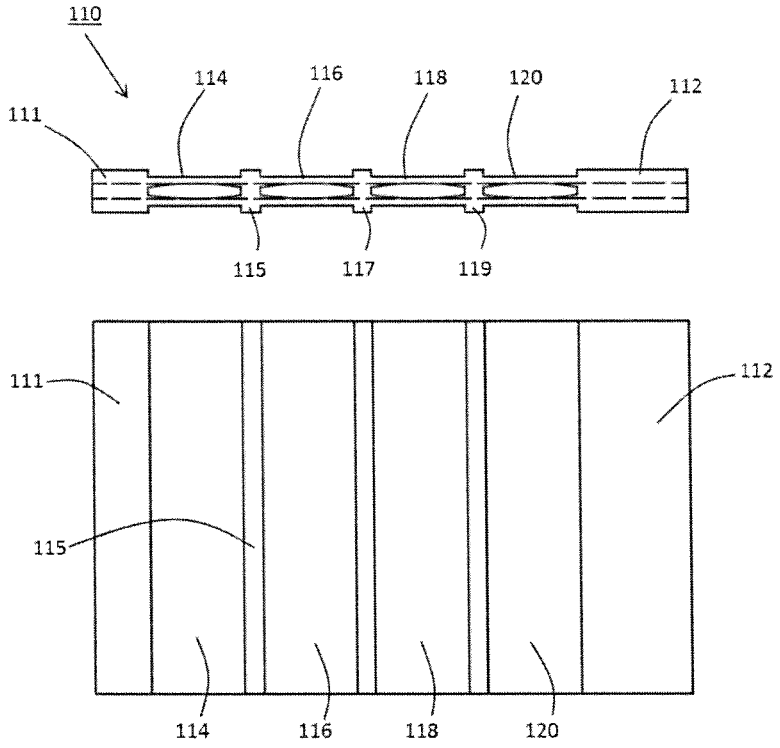
FIG. 7 is a side view and a top view of the ductility element illustrated in FIG. 5.

The embodiment of the ductility element (110) shown in FIG. 6 is shown as a side view and a top view in FIG. 7.

In FIG. 7 the ductility element (110) comprises a first end (111), a second end (112), four deformable walls (114,116,118,120) and a through going channel (113) adapted for receiving a tendon, the through going channel extends centrally internal through said ductility element, from said first end (111) to the second end (112). The four deformable walls (114,116,118,120) are divided into sequential zones by the partitions (115,117,119), defining four compression zones.

The second end (112) may be configured to cooperate with an anchor for fixing the tendon to provide a structural connection between the ductility element and the tendon.

Figure 8:
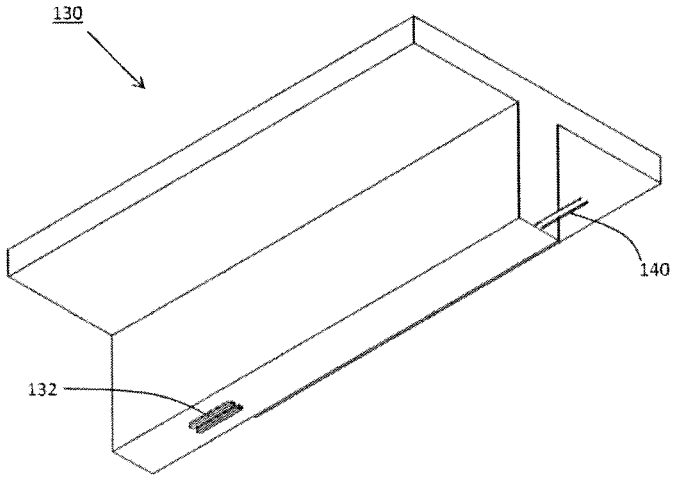
FIG. 8 is a perspective view of a T-shaped structure.
Figure 9:
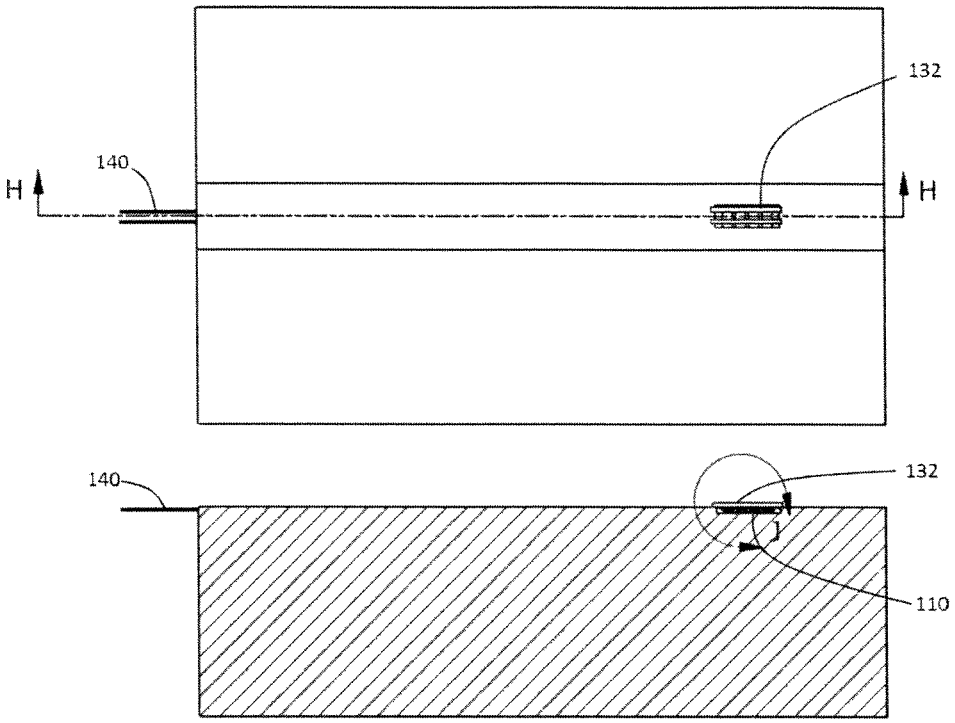
FIG. 9 illustrates a bottom view of the T-shaped structure illustrated in FIG. 7, and a cross sectional view of the T-shaped structure in the line indicated by H, the sub section of the T-structure indicated by J is illustrated in FIG. 9 in an enlarged view.

The above mentioned embodiment of the ductility element (110) is incorporated in a reinforcement system in a structure (130) having a T-shaped cross section illustrated in FIGS. 8 and 9.

The ductility element (110) is positioned inside the T-shaped structure (130) just below the surface of the structure and is secured by a cover part (132). A flat tendon (140) leads through the structure and extend beyond the extremity of the structure (130).

Figure 10:
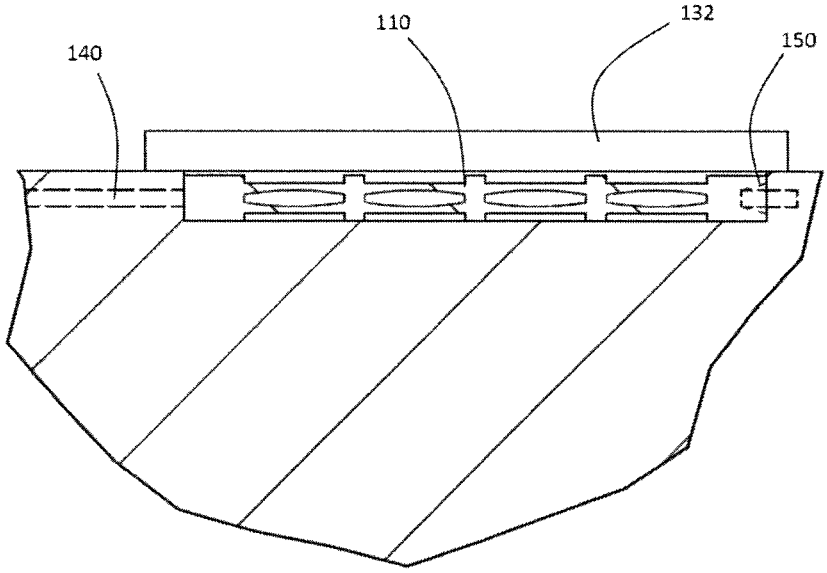
FIG. 10 is an enlarged side view of the sub section of the cross sectional view of the T-shaped structure which is shown in FIG. 8, in FIG. 8 the sub section is indicated by J.

FIG. 9 illustrates a bottom view of the T-shaped structure, and a cross sectional view of the T-shaped structure in the line indicated by H, the sub section indicated by J is illustrated in FIG. 10 in an enlarged view.

The enlarged side view of the reinforcement system, shown in FIG. 10, comprises a ductility element (110) and a tendon (140), which is fixed by an anchor (150) at one extremity of the ductility element (110).

Figure 11:
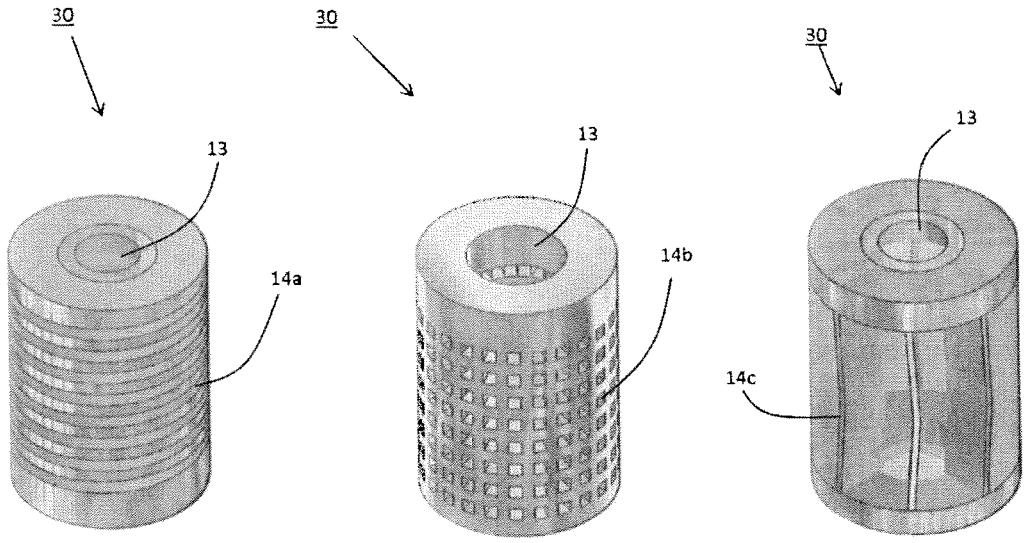
FIG. 11 illustrates three embodiments of the ductility element.

FIG. 11 illustrates three embodiments of the weakened deformable zones of a ductility element (30).

The weakened deformation zones may be provided by slits (14*a*), holes (14*b*), such as voids or bubbles, varying thickness of the deformable walls, and/or by use of a material providing a deformable zone. The deformation walls (14*c*) may be adapted to deform along the periphery of the ductility element in tangential direction.

The weakened deformation zones are weakened in relation to the other parts of the ductility element. The weakened deformation zones may also be provided by suitable choice of material.

The ductility element may be made of metal such as steel or aluminum, cementitious material, plastics, or elastic material such as rubber, composite material or combination thereof.

The invention claimed is:

1. A structure with a reinforcement system for anchoring tendons for structural reinforcing the structure such as a concrete structure, said reinforcement system comprises at least one anchor and at least one tendon, said anchor is adapted to fix said tendon in or outside said structure, wherein said reinforcement system comprises a ductility element, which is positioned in structural connection relative to said tendon and said anchor, said ductility element being positioned adjacent to and in contact with said anchor and in a non-overlapping manner in relation to said anchor in an axial direction along a length of said tendon, said anchor including a barrel fixed at an end of said tendon extending from the structure, said anchor including a wedge that is wedged coaxially inside said barrel to clamp said tendon inside said barrel, said ductility element being positioned at one extremity of said anchor as an extension of the barrel such that said tendon extends through said ductility element, said ductility element comprising weakened deformation zones, said weakened deformation zones are configured for increasing the ductility of said reinforcement system, said weakened deformation zones being deformable and thereby configured for allowing the length of weakened deformation zones on the ductility element to increase or decrease in an axial direction along the length of said tendon when stress on the ductility element exceeds a level, wherein the ductility element includes a first end, a second end, and a through going channel disposed internally within one or more of the weakened deformation zones, the tendon being received in said through going channel, the through going channel being at least partially hollow and disposed such that a tensile force on the tendon during use is oriented along an extension of the through going channel so that all of the weakened deformation zones are subjected to a same force applied by a stress in the tendon, and a weakest of the weakened deformation zones will thereby collapse first, the weakened deformation zones being defined by one or more walls arranged around the through going channel such that the one or more walls, when a threshold for elastic deformation is reached, start to deform resulting in collapse of the one or more walls, wherein the first end of the ductility element cooperates with the structure to transfer a load axially along the tendon from the tendon to the structure, and wherein the second end of the ductility element cooperates with the anchor fixed to the tendon via the wedge and the barrel, thereby providing said structural connection, the ductility element being configured such that a force required to deform the ductility element in axial load is less than a force required to deform the tendon.

2. A structure according to claim 1, wherein said weakened deformation zones are positioned subsequent in the axial direction along the length of said tendon, thus providing subsequent deformable zones, enabling a sequence of ductility.

3. A structure according to claim 1, wherein the ductility element has a ductile phase in axial load less than the tensile strength of the tendon.

4. A structure according to claim 1, wherein said ductility element is configured such that the force required for deformation of the ductility element in axial load being about 30-95%, or 70-95% of the force required for deformation of said tendon.

5. A structure according to claim 1, wherein the ductility element is an integrated part of said anchor.

6. A structure according to claim 1, wherein said ductility element comprises a circular cross section and said wedge is a compressible wedge disposed in said barrel.

7. A structure according to claim 2, wherein the ductility element has a ductile phase in axial load less than the tensile strength of the tendon.

8. A structure according to claim 1, wherein the ductility element has a ductile phase in axial load less than the tensile strength of the tendon.

9. A structure according to claim 1, wherein the ductility element is cast directly into the structure.

10. A structure according to claim 6, wherein the barrel has a tapered inner bore, and said compressible wedge is coaxially disposed in said barrel.

11. A structure according to claim 1, wherein the one or more walls is a plurality of walls having varying thicknesses.

12. A reinforcement system to anchor tendons to structurally reinforce a structure to be reinforced, the reinforcement system comprising:

a tendon;

an anchor configured to fix the tendon in or outside the structure to be reinforced, the anchor including a barrel fixed at an end of the tendon and a wedge that is wedged coaxially inside the barrel to clamp the tendon inside the barrel; and a ductility element positioned at one extremity of the anchor and in contact with the anchor as an extension of the barrel such that the tendon extends through the ductility element, the ductility element having a first end, a second end, a through-going channel, and weakened deformation zones defined by one or more walls arranged around the through-going channel such that the one or more walls, when a threshold for elastic deformation is reached, start to deform resulting collapse of the one or more walls, the tendon being received in the through-going channel, wherein the first end cooperates with the structure to transfer a load axially along the tendon from the tendon to the structure, and the second end cooperates with the anchor fixed to the tendon via the wedge and the barrel.

13. A structure with a reinforcement system for anchoring tendons for structural reinforcing the structure such as a concrete structure, said reinforcement system comprises at least one anchor and at least one tendon, said anchor is adapted to fix said tendon in or outside said structure, wherein said reinforcement system comprises a ductility element, which is positioned in structural connection relative to said tendon and said anchor, said ductility element being positioned adjacent to and in contact with said anchor and in a non-overlapping manner in relation to said anchor in an axial direction along a length of said tendon, said anchor including a barrel fixed at an end of said tendon extending from the structure, said anchor including a wedge that is wedged coaxially inside said barrel to clamp said tendon inside said barrel, said ductility element being positioned at one extremity of said anchor as an extension of the barrel such that said tendon extends through said ductility element, said ductility element comprising weakened deformation zones, said weakened deformation zones are configured for increasing the ductility of said reinforcement system, said weakened deformation zones being deformable and thereby configured for allowing the length of weakened deformation zones on the ductility element to increase or decrease in an axial direction along the length of said tendon when stress on the ductility element exceeds a level, wherein the ductility element includes a first end, a second end, and a through going channel disposed internally within one or more of the weakened deformation zones, the tendon being received in said through going channel, the through going channel being at least partially hollow and disposed such that a tensile force on the tendon during use is oriented along an extension of the through going channel so that all of the weakened deformation zones are subjected to a same force applied by a stress in the tendon, and a weakest of the weakened deformation zones will thereby collapse first, the weakened deformation zones being defined by one or more walls arranged around the through going channel such that the one or more walls, when a threshold for elastic deformation is reached, start to deform resulting in collapse of the one or more walls, wherein the one or more walls is a plurality of walls having varying thicknesses, wherein the first end of the ductility element cooperates with the structure to transfer a load axially along the tendon from the tendon to the structure, and wherein the second end of the ductility element cooperates with the anchor fixed to the tendon via the wedge and the barrel, thereby providing said structural connection, the ductility element being configured such that a force required to deform the ductility element in axial load is less than a force required to deform the tendon.

* * * * *